US010399108B2

(12) United States Patent
Crawford et al.

(10) Patent No.: US 10,399,108 B2
(45) Date of Patent: Sep. 3, 2019

(54) SPRINKLER WITH MODULAR COMPONENTS AND POP UP DEFLECTOR

(71) Applicant: Nelson Irrigation Corporation, Walla Walla, WA (US)

(72) Inventors: Steven E. Crawford, Walla Walla, WA (US); Craig B. Nelson, Walla Walla, WA (US)

(73) Assignee: NELSON IRRIGATION CORPORATION, Walla Walla, WA (US)

( * ) Notice: Subject to any disclaimer, the term of this patent is extended or adjusted under 35 U.S.C. 154(b) by 0 days.

(21) Appl. No.: 15/365,461

(22) Filed: Nov. 30, 2016

(65) Prior Publication Data

US 2018/0147592 A1 May 31, 2018

(51) Int. Cl.

| | |
|---|---|
| ***B05B 1/32*** | (2006.01) |
| ***B05B 3/00*** | (2006.01) |
| ***B05B 3/04*** | (2006.01) |
| ***B05B 3/06*** | (2006.01) |
| ***B05B 15/16*** | (2018.01) |
| ***B05B 15/50*** | (2018.01) |
| ***B05B 15/65*** | (2018.01) |
| ***B05B 15/74*** | (2018.01) |

(52) U.S. Cl.

CPC ..... *B05B 15/16* (2018.02); *B05B 3/003* (2013.01); *B05B 3/005* (2013.01); *B05B 3/0486* (2013.01); *B05B 3/063* (2013.01); *B05B 15/50* (2018.02); *B05B 15/65* (2018.02); *B05B 1/323* (2013.01); *B05B 15/74* (2018.02)

(58) Field of Classification Search

CPC ..... B05B 3/003; B05B 3/0486; B05B 3/063; B05B 15/02; B05B 15/065; B05B 1/007

See application file for complete search history.

(56) References Cited

U.S. PATENT DOCUMENTS

| | | | | |
|---|---|---|---|---|
| 2,488,234 | A | 11/1949 | Perry | |
| 2,979,271 | A | 4/1961 | Boyden | |
| 3,888,417 | A | 6/1975 | Harmon | |
| 4,540,125 | A | 9/1985 | Gorney et al. | |
| 4,637,549 | A | 1/1987 | Schwartzman | |
| 4,886,211 | A | 12/1989 | Cohen | |
| 4,984,740 | A | 1/1991 | Hodge | |
| 5,007,586 | A | 4/1991 | Cohen | |
| 5,377,914 | A * | 1/1995 | Christen | B05B 3/005 239/252 |
| 6,827,291 | B2 * | 12/2004 | Townsend | B05B 3/005 239/206 |
| 7,395,977 | B2 | 7/2008 | Pinch et al. | |
| 8,434,695 | B2 | 5/2013 | Barzuza | |
| 8,998,109 | B2 * | 4/2015 | Katzman | B05B 3/005 239/222.11 |
| 2011/0114755 | A1 * | 5/2011 | Katzman | B05B 3/005 239/222.17 |

FOREIGN PATENT DOCUMENTS

| | | |
|---|---|---|
| KR | 10-1693260 | 12/2016 |

* cited by examiner

*Primary Examiner* — Christopher S Kim

(74) *Attorney, Agent, or Firm* — Nixon & Vanderhye P.C.

(57) ABSTRACT

A sprinkler includes a pop-up deflector plate that is engageable with a brake assembly in an extended position. A brake module is secured to a sprinkler body and includes a rotatable connector coupled with the brake assembly. The pop-up deflector plate is disposed adjacent the nozzle and engages the rotatable connector in the extended position.

12 Claims, 18 Drawing Sheets

SPRINKLER WITH MODULAR COMPONENTS AND POP UP DEFLECTOR

CROSS-REFERENCES TO RELATED APPLICATIONS (Not Applicable)

STATEMENT REGARDING FEDERALLY SPONSORED RESEARCH OR DEVELOPMENT (Not Applicable)

BACKGROUND

The invention relates to a modular industrial sprinkler including a pop-up deflector and, more particularly, to a selectively configurable sprinkler assembly with a pop-up deflector that is operable as a rotator or a spinner.

Industrial sprinklers with exposed nozzles may be prone to clogging due to debris that may collect in or around the nozzle. Blocked nozzles detrimentally affect sprinkler patterns and are time-consuming to clean and maintain. Debris may similarly collect around a spinning deflector plate, which can slow or jam the deflector plate.

BRIEF SUMMARY

It would thus be desirable to provide a sprinkler assembly including a pop-up deflector that protects the nozzle during periods of non-use. It would also be desirable to incorporate the pop-up deflector in a rotator assembly, including a brake or the like, to better control sprinkler patterns during use. It would still further be desirable for a sprinkler assembly to be constructed using modular components that are selectively configurable to achieve different characteristics for a sprinkler assembly.

In an exemplary embodiment, a sprinkler includes a pop-up deflector plate that is engageable with a brake assembly in an extended position. A brake module is secured to a sprinkler body and includes a rotatable connector coupled with the brake assembly. A nozzle module is cooperable with the sprinkler body and includes a nozzle, and the deflector plate is cooperable with the nozzle module and is disposed adjacent the nozzle. The deflector plate is displaceable in the nozzle module between a retracted position and the extended position. The deflector plate includes a stream deflector surface and a torque shaft, where the torque shaft is engaged with the rotatable connector in the extended position.

The torque shaft may be engaged with the rotatable connector in the retracted position. The rotatable connector may include a channel with a cross-sectional shape, where the torque shaft may be shaped corresponding to the cross-sectional shape to engage the channel and to transfer torque between the deflector plate and the rotatable connector. In some embodiments, the cross-sectional shape may be square, and the torque shaft may be shaped to fit in the square shape. The cross-sectional shape may contain ridges, where the torque shaft may be provided with splines engageable with the ridges.

The nozzle module may include a nozzle top coupled with a nozzle base, where the deflector plate may be displaceable between the retracted position and the extended position in the nozzle top. The nozzle module may be connected to the sprinkler body in a snap fit. The rotatable connector may be positioned so as to act as a stop limit for the deflector plate in the extended position.

In some embodiments, the torque shaft may be tapered such that the torque shaft is disengaged from the rotatable connector in the retracted position.

The sprinkler may also include a base unit to which the nozzle module can be secured. The base unit has connecting structure connectable with a source of water under pressure.

In a hanging rotator embodiment, the sprinkler may be provided with a spring acting between the rotatable connector and the deflector plate that biases the deflector plate toward the retracted position.

The deflector plate may include a breakaway diffuser tab.

The brake module, the nozzle module and the deflector plate may be modular components. In this context, the sprinkler may include a plurality of brake modules with varying braking characteristics, a plurality of nozzle modules with varying flow characteristics, and a plurality of deflector plates with varying stream disbursement characteristics, where the pluralities of brake modules, nozzle modules and deflector plates may be selectively and independently attachable to the sprinkler body.

In another exemplary embodiment, a sprinkler assembly includes a plurality of interchangeable modular components. The sprinkler assembly includes a sprinkler body including couplers for securing the interchangeable modular components. The plurality of interchangeable components include a plurality of brake modules each securable to the sprinkler body, a plurality of nozzle modules each securable to the sprinkler body, and a plurality of deflector plates each cooperable with the plurality of nozzle modules and disposed adjacent the nozzle. The plurality of brake modules respectively have varying braking characteristics from no braking to maximum braking, where each of the brake modules includes a rotatable connector. Each of the plurality of nozzle modules includes a nozzle having a nozzle size, where the respective nozzle sizes of the plurality of nozzle modules reflect varying flow characteristics. The deflector plates are each displaceable in the respective nozzle module between a retracted position and an extended position, and the deflector plates each include a stream deflector surface and a torque shaft. The torque shaft is engaged with the rotatable connector in the extended position.

In some embodiments, the sprinkler assembly includes a jewel cup bearing mounted in the rotatable connector and a ball bearing disposed at a distal end of the torque shaft and engaged with the jewel cup bearing with the deflector plate in the extended position.

In yet another exemplary embodiment, a sprinkler includes a sprinkler body; a brake module secured to the sprinkler body and including a rotatable connector coupled with a brake assembly; a nozzle; and a pop-up deflector plate disposed adjacent the nozzle and engaging the rotatable connector in an extended position.

BRIEF DESCRIPTION OF THE DRAWINGS

These and other aspects and advantages will be described in detail with reference to the accompanying drawings, in which.

DETAILED DESCRIPTION

Figure 1:
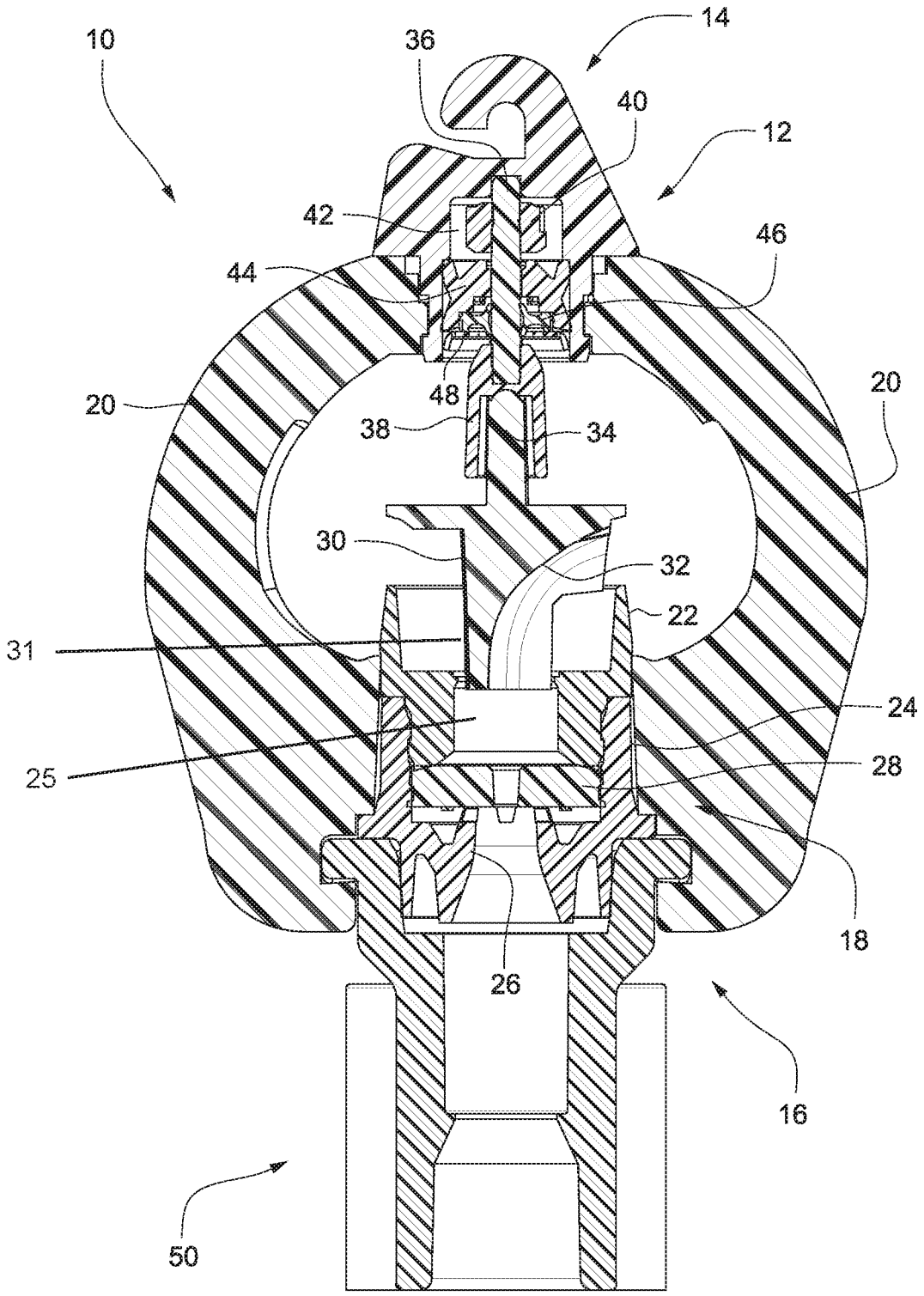
FIGS. 1 and 2 are sectional views of a sprinkler assembly according to one embodiment.

The sprinkler of the described embodiments results in a lower cost pop-up sprinkler that is configurable either as a rotator (i.e., incorporating a brake to control rotation speed) or a spinner (i.e., freely rotating). The sprinkler includes modular components so that the nozzle, deflector and brake functions can be varied according to user specifications. In a rotator configuration, the pop-up deflector plate is engageable in an extended position with a brake assembly. The brake module is secured to a sprinkler body and includes a rotatable connector coupled with the brake assembly. The pop-up deflector plate is disposed adjacent the nozzle and engages the rotatable connector in the extended position. With the modular construction, the brake assembly can be interchanged with a spinner assembly. Additionally, the nozzle module may or may not be provided with flow control structure and similarly may be interchanged with an alternative nozzle module. Still further, the deflector plate can be interchanged with alternative deflector plates to reflect desired sprinkler patterns.

FIGS. 1-4 show an exemplary configuration. The sprinkler includes a sprinkler body 10 that serves as connecting structure for the modular components of an assembled sprinkler. The sprinkler body 10 includes a first compartment 12 for securing a brake module 14 and a second compartment 16 for securing a nozzle module 18. The nozzle module 18 may be connected to the sprinkler body 10 in a snap fit. Sprinkler body arms 20 extend between the first and second compartments 12, 16.

The nozzle module 18 includes a nozzle top 22 engaged with a nozzle base 24. In some embodiments, the nozzle top 22 is coupled with the nozzle base 24 in a snap fit. The nozzle top 22 includes a deflector plate receiving channel 25. The nozzle base 24 may include an integrated nozzle 26 through which a stream of water is emitted. A flow washer 28 may be included to provide flow control from the nozzle 26.

A deflector plate 30 is cooperable with the nozzle module 18 and is disposed adjacent the nozzle 26. The deflector plate includes a shaft section 31 that is sized to fit in the deflector plate receiving channel 25 of the nozzle top 22. The water stream flowing through the nozzle 26 is directed to the deflector plate 30, which is provided with a stream deflector surface 32 for turning and distributing the water stream. The stream deflector surface 32 is shaped to cause the deflector plate 30 to rotate when impacted with the water stream from the nozzle 26. The deflector plate 30 is displaceable in the nozzle top 22 of the nozzle module 18 between a retracted position (shown in FIGS. 2 and 4) and an extended position (shown in FIGS. 1 and 3). The deflector plate 30 also includes a torque shaft 34 extending from a side of the deflector plate 30 opposite from the side facing the nozzle 26.

The brake module 14 is secured in the first compartment 12 and includes a shaft 36 coupled with a rotatable connector 38. The brake module can be of any type suitable for the intended purpose. In some embodiments, the brake module is a viscous brake assembly including a rotor attached to the shaft 36 and disposed in a pool of viscous fluid 42. The rotor 40 and viscous fluid 42 serve to resist rotation of the shaft 36. The viscous brake assembly may also include a bearing 44 in which the shaft 36 is rotatable, and a seal 46 and retainer 48 to enclose and secure the assembly. Other types of brake assemblies may be incorporated into the brake module 14.

Figure 2:
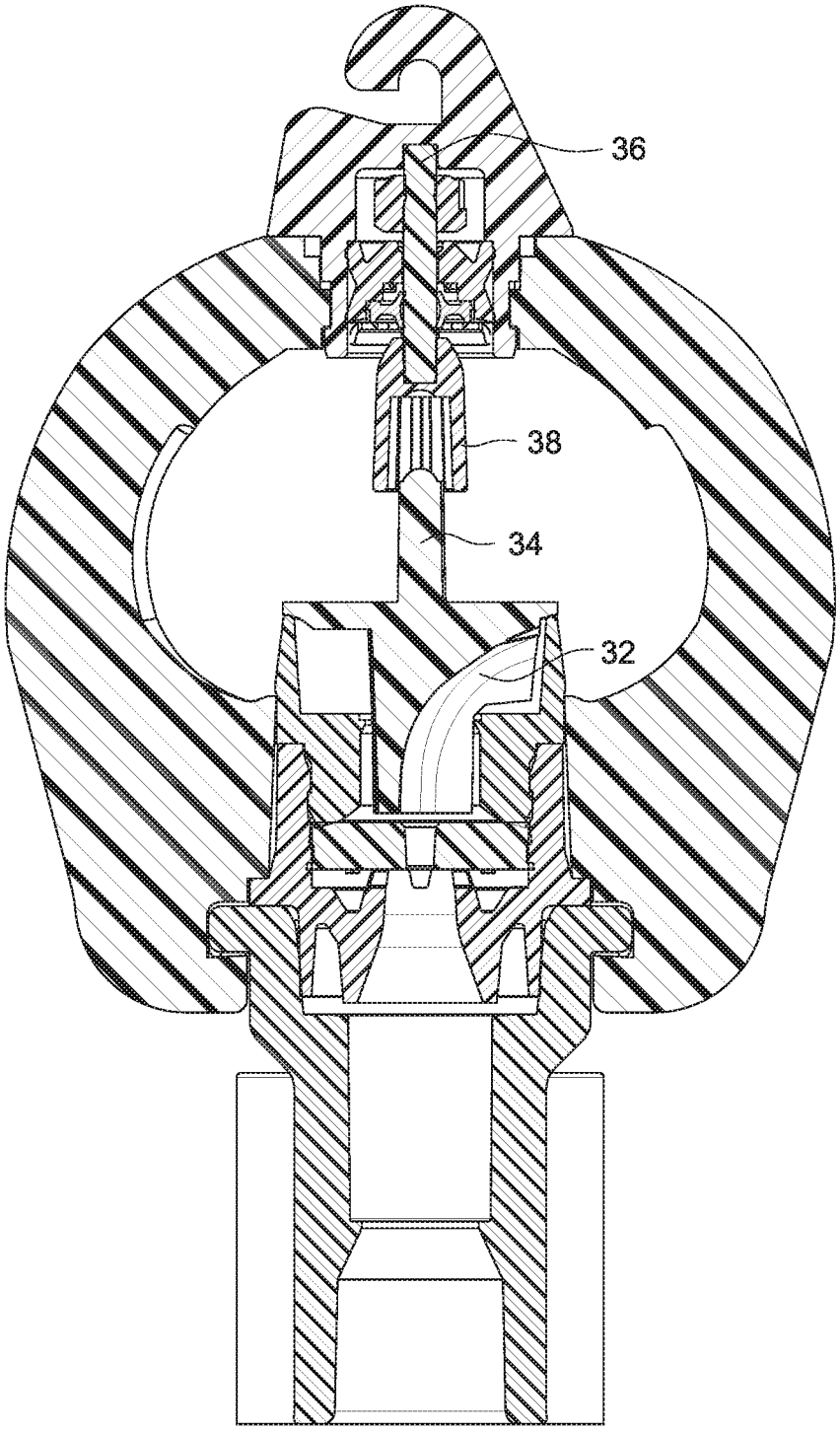
Figure 3:
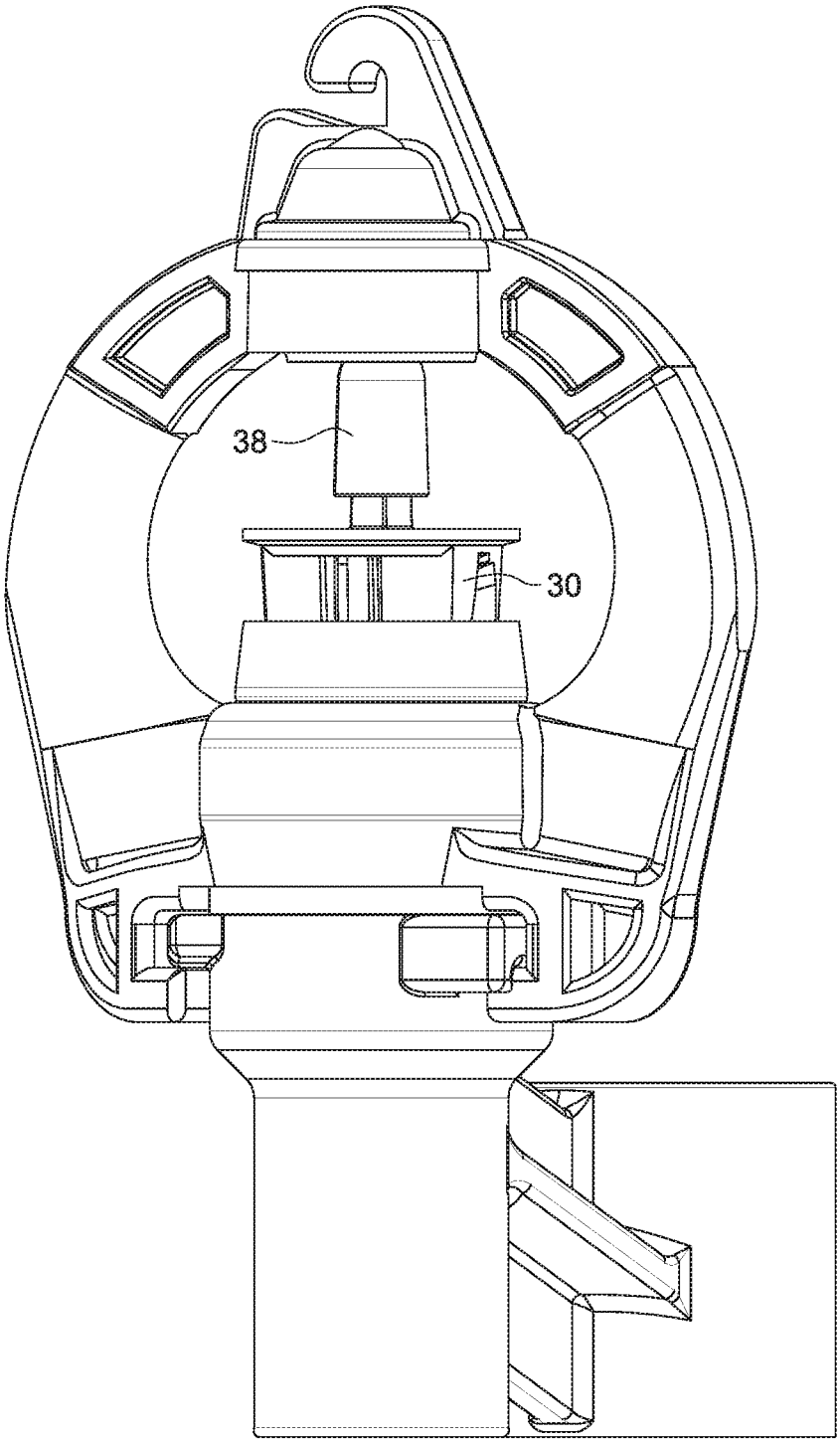
FIGS. 3 and 4 show the sprinkler assembly of FIGS. 1 and 2 with the deflector plate in an extended and a retracted position, respectively.
Figure 4:
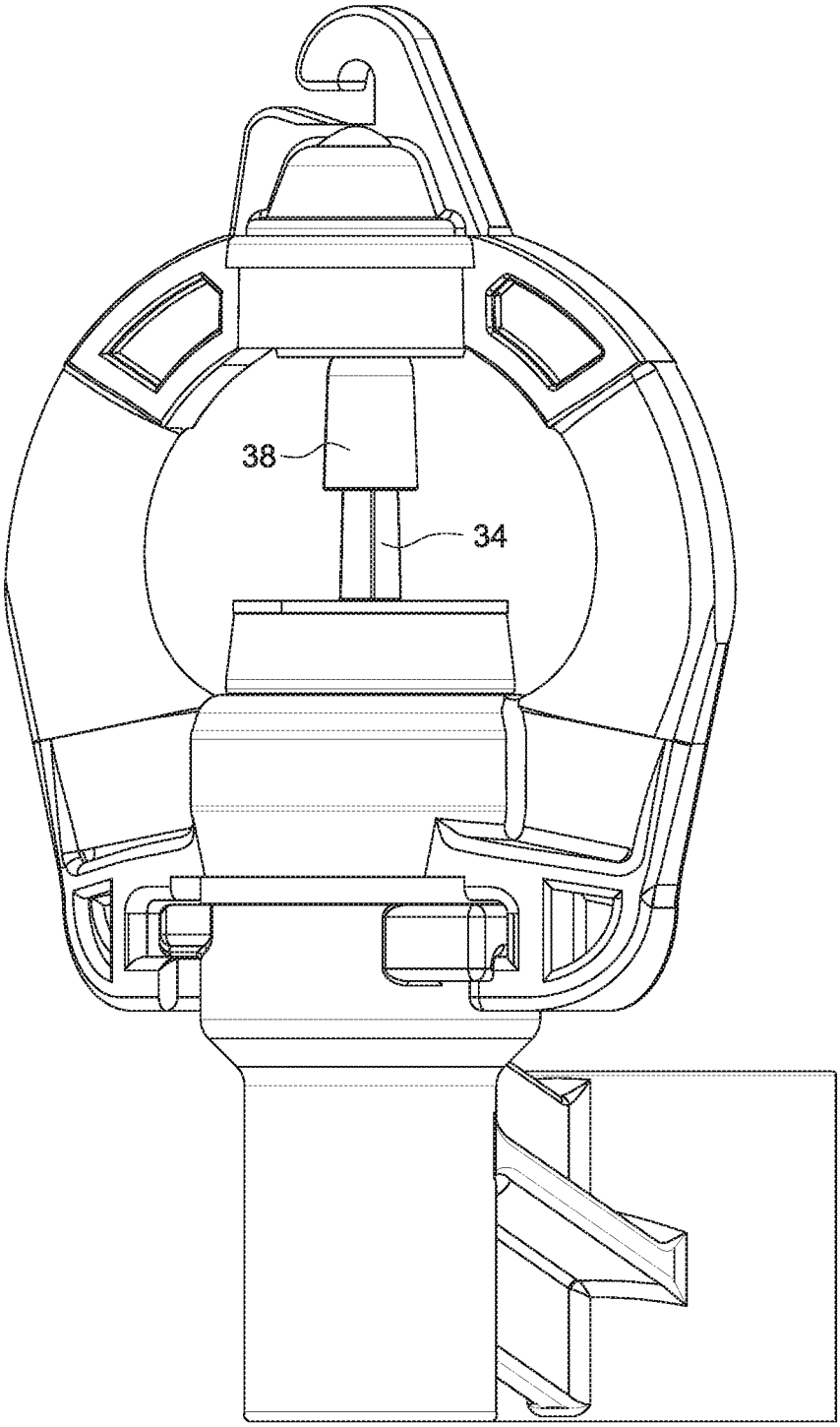
Figure 5:
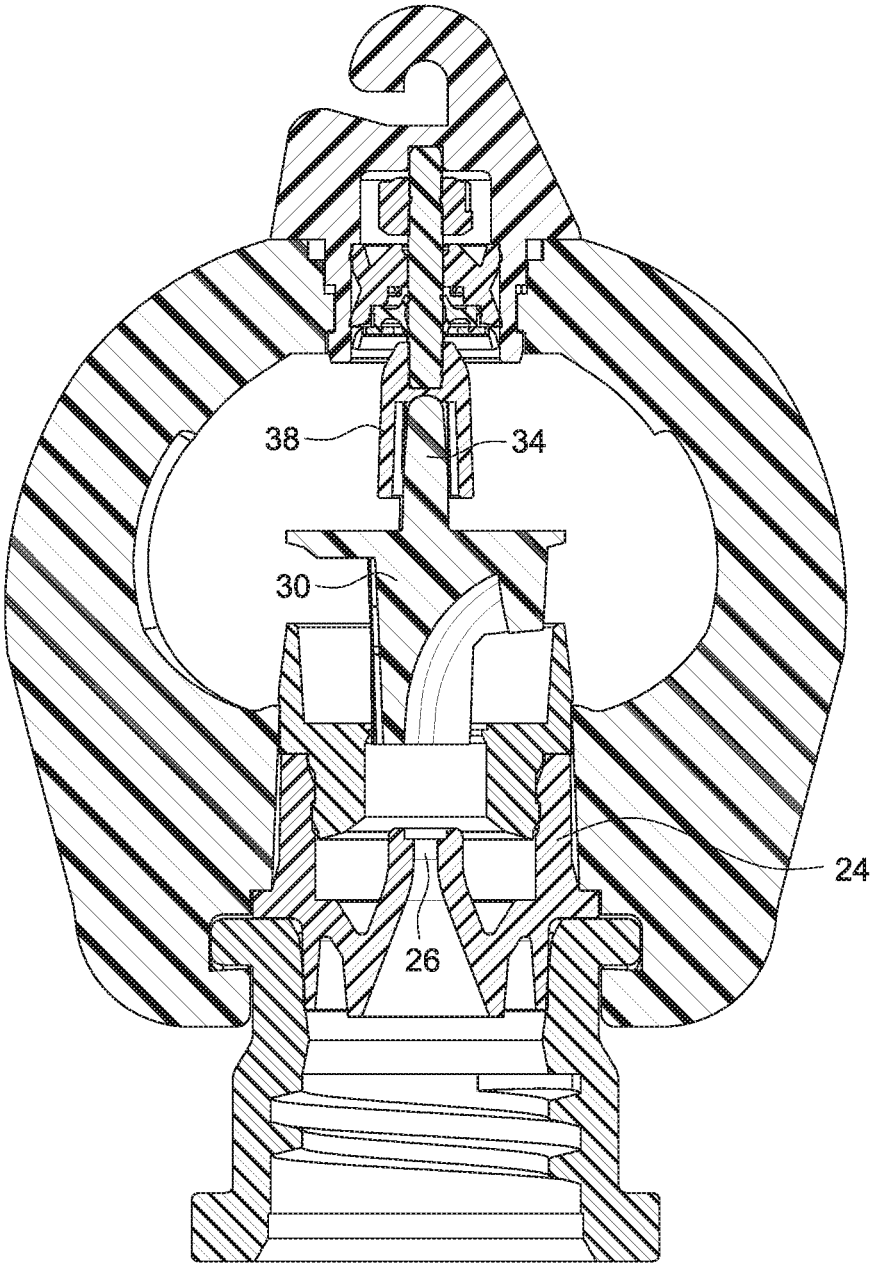
FIGS. 5-8 show a sprinkler assembly including available variations by virtue of the modular construction of the sprinkler assembly.
Figure 6:
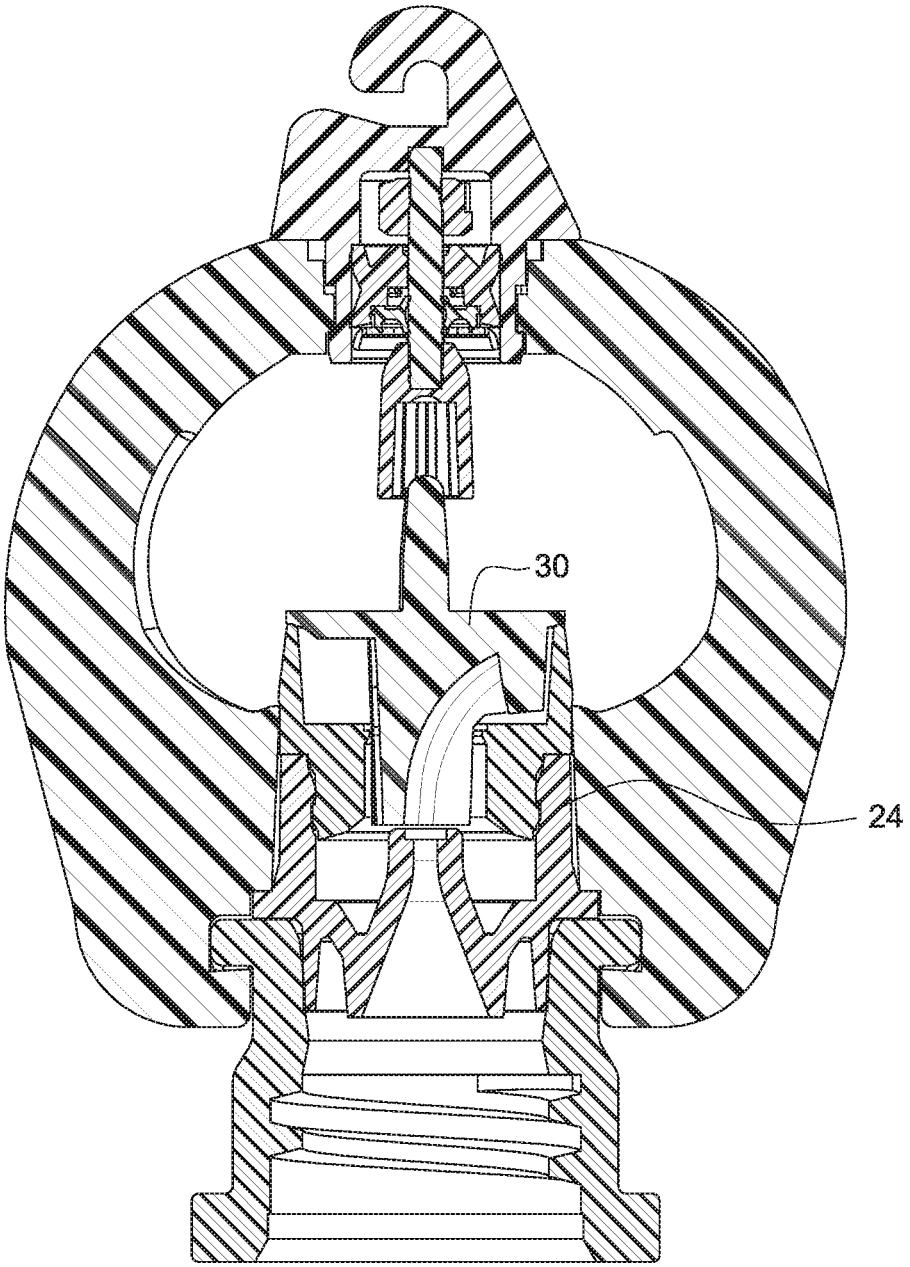
Figure 7:
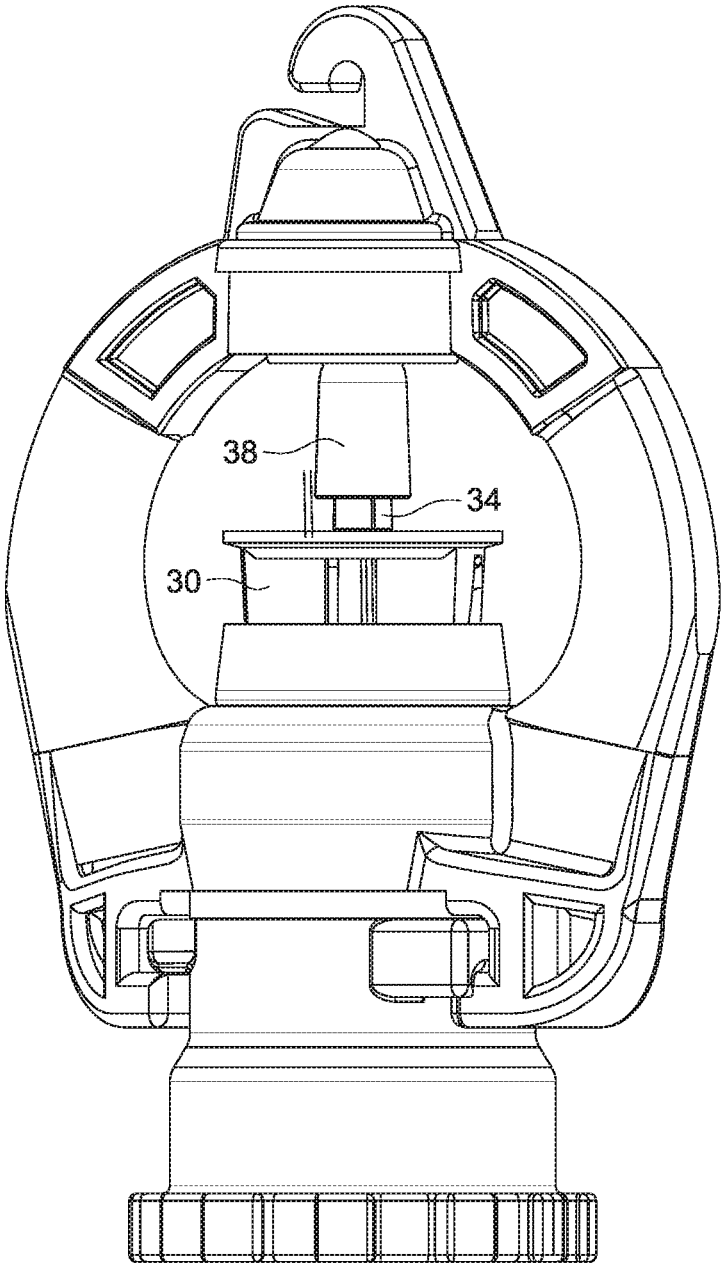
Figure 8:
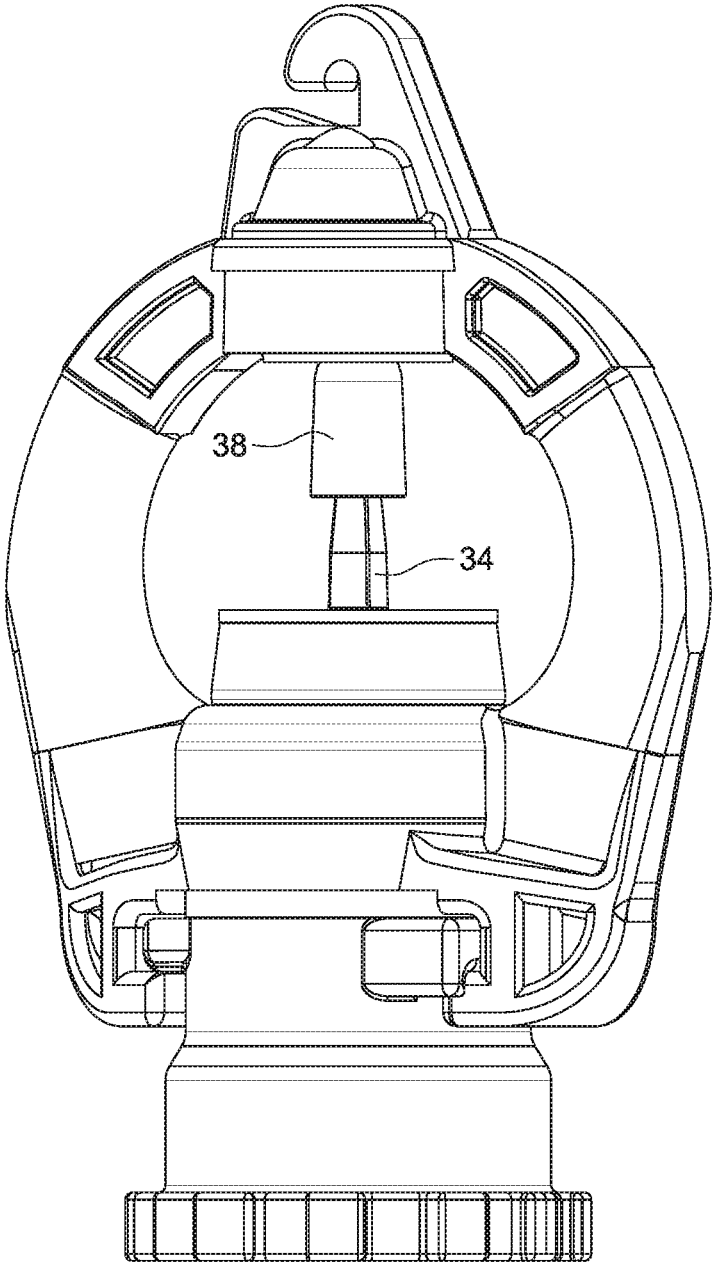
Figure 9:
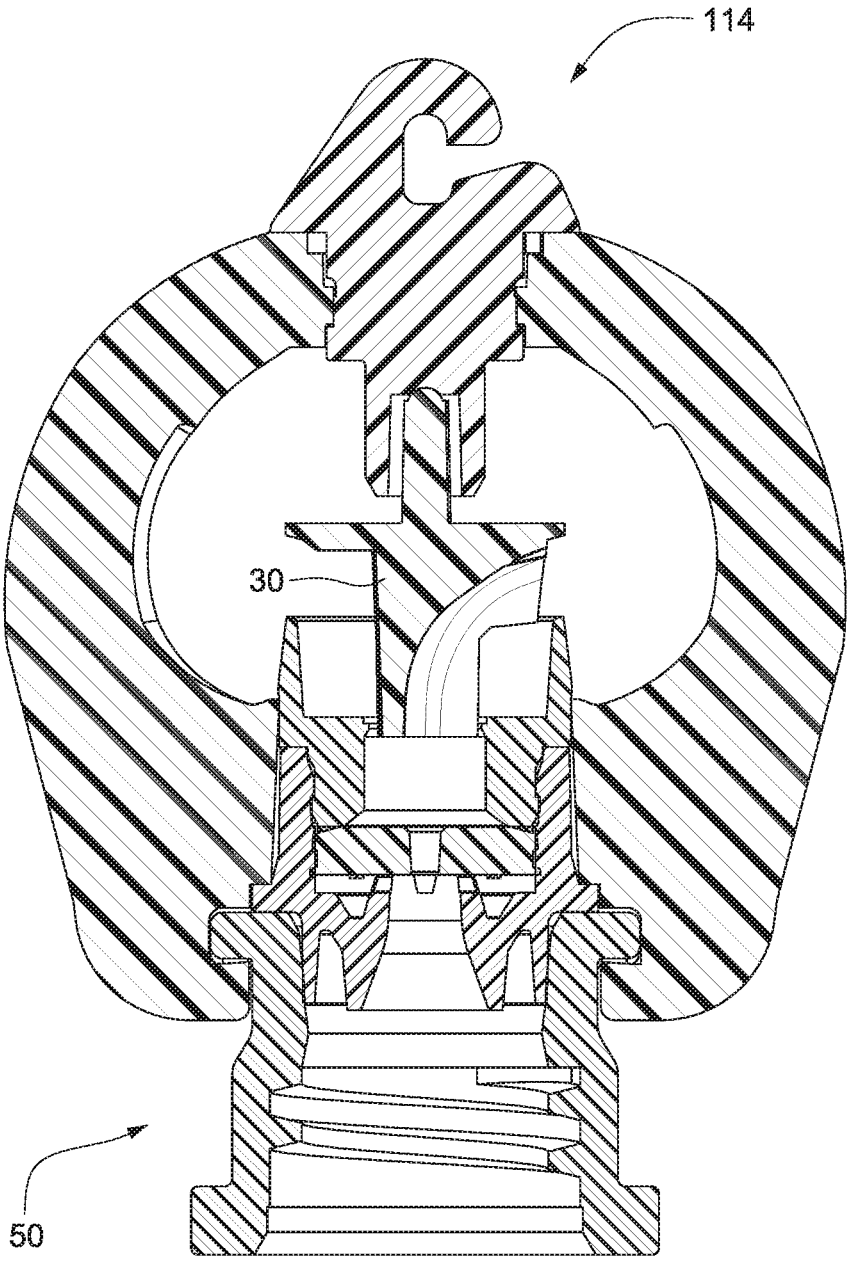
FIGS. 9-12 show a spinner variation of the sprinkler assembly.

With continued reference to FIGS. 1 and 3, the torque shaft 34 is engaged with the rotatable connector 38 in the extended position. The engagement between the torque shaft 34 and the rotatable connector 38 enables a mutual torque exchange between the torque shaft 34 and the rotatable connector 38. That is, the rotatable connector 38 may include a channel with a cross-sectional shape, where the torque shaft 34 is shaped corresponding to the cross-sectional shape to engage the channel and to transfer torque between the deflector plate 30 and the rotatable connector 38. In the embodiment shown in FIGS. 1 and 2, the cross-sectional shape includes ridges, where the torque shaft 34 includes splines that are engageable with the ridges. In FIGS. 3 and 4, the cross-sectional shape is square, and the torque shaft 34 is shaped to fit in the square shape. Any combination of cross-sectional shapes and torque shaft shapes may be utilized, and the invention is not necessarily meant to be limited to the illustrated variations. Other shapes and/or connection types may be used to achieve the intended functionality.

In some embodiments, the torque shaft 34 is engaged with the rotatable connector 38 in both the extended position and the retracted position. With such an engagement, the deflector plate 30 and the rotatable connector 38 are coupled before a water stream is emitted through the nozzle 26. In alternative embodiments, the torque shaft 34 is detached from the connector 38 in the retracted position (see the discussion below with reference to FIGS. 5-8). As a consequence, the deflector plate 30 begins to rotate freely at start-up until the torque shaft 34 engages the rotatable connector 38. This configuration may be desirable when a strong brake is utilized for a particular application. The spinning deflector plate can provide some momentum and kinetic energy before engaging the rotatable connector 38 to overcome a potentially difficult start.

With continued reference to FIGS. 1 and 2, the deflector plate 30 is displaceable between the retracted position and the extended position in the nozzle top 22. As shown, the rotatable connector 38 is positioned so as to act as a stop limit for the deflector plate 30 in the extended position. That is, the pop-up range of the deflector plate 30 is defined by the seat on the nozzle top 22 on which the deflector plate 30 is engaged in the retracted position (see FIG. 2) and the depth of the rotatable connector 38 in which the torque shaft 34 is disposed in the extended position (see FIG. 1). The deflector plate 30 may thus be simply placed in the nozzle top 22 during assembly without requiring an active connection.

To assemble the sprinkler, the nozzle module 18 may be snapped into the second compartment 16 of the sprinkler body 10, and the deflector plate 30 is set in the nozzle top 22. The brake module 14 may be secured in the first compartment 12 using any suitable connector such as a quarter-turn lock. This known type of lock is useful for connecting plastic pieces and utilizes tabs and ridges to secure parts with a quarter-turn or twist lock. The brake module 14 is installed such that the rotatable connector 38 is engaged or aligned with the torque shaft 34.

A similar quarter-turn lock or the like may be used to secure the assembly on a base unit 50. The base unit 50 includes connecting structure connectable with a source of water under pressure. In some embodiments, the base unit 50 includes a stake adapter or the like connectable via a quarter-turn lock. Alternatively, the base unit 50 may be threaded using a threaded Acme connector or may be press fit and glued.

In use, before a water stream flows through the nozzle 26, the deflector plate 30 is disposed in its retracted position as shown in FIGS. 2 and 4 by gravity. When water flows through the nozzle 26, the water stream impacts the stream deflector surface 32 and displaces the deflector plate 30 from the retracted position to the extended position as shown in FIGS. 1 and 3. The emitting stream also causes the deflector plate 30 to rotate by virtue of the shape of the stream deflector surface 32. In the extended position, the deflector plate 30 is prevented from freely rotating by the engagement between the torque shaft 34 and the rotatable connector 38, which in turn is coupled with the brake module 14. The amount of braking can be controlled depending on the intended application by interchanging one brake module with another. An alternative brake module may include a fluid with lower viscosity or no brake at all (resulting in a spinner configuration).

FIGS. 5-8 illustrate variations on the sprinkler assembly. In the illustrated variation, the torque shaft 34 is tapered such that the torque shaft 34 is disengaged from the rotatable connector 38 in the retracted position. The variation shown in FIGS. 5-8 also includes an alternative nozzle base 24 and standard nozzle 26 without the flow control washer 28 shown in FIG. 1.

Figure 10:
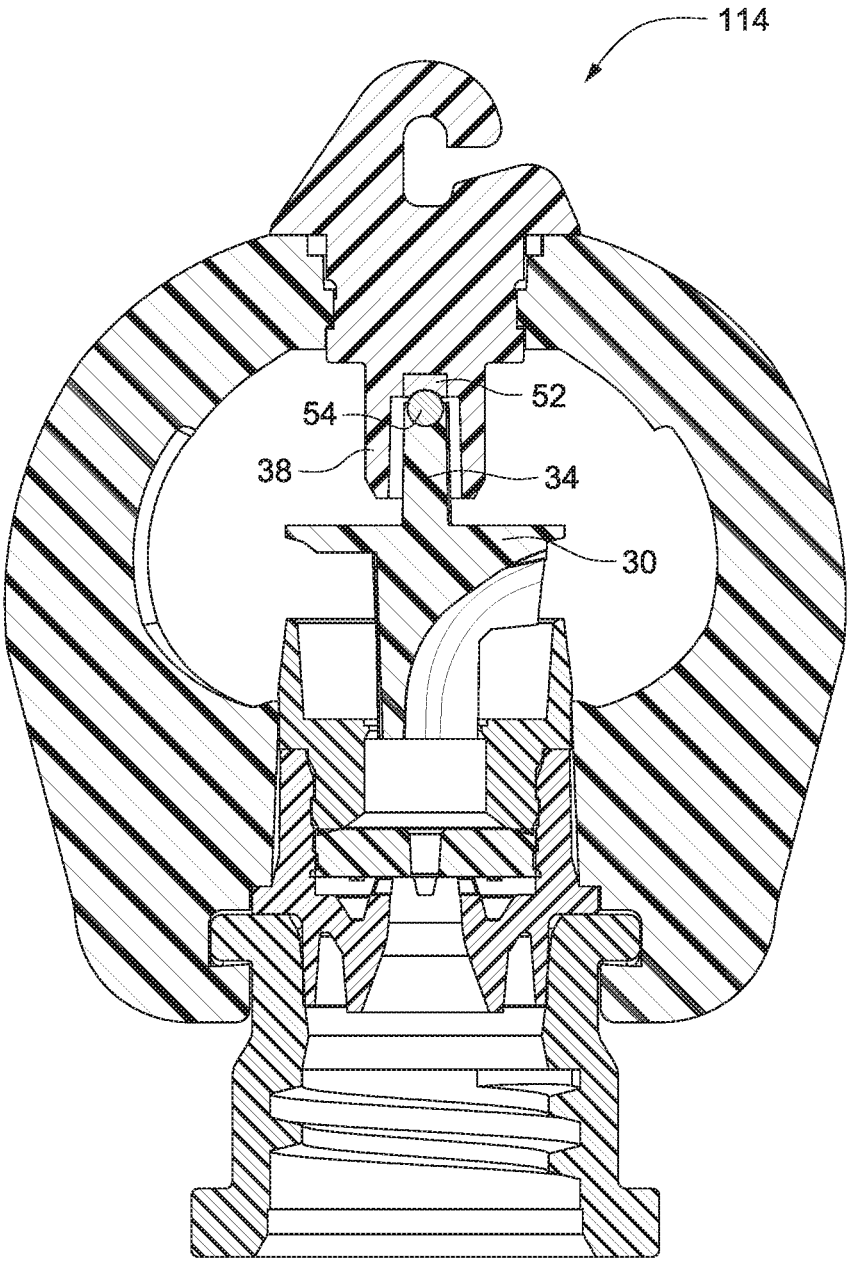
Figure 11:
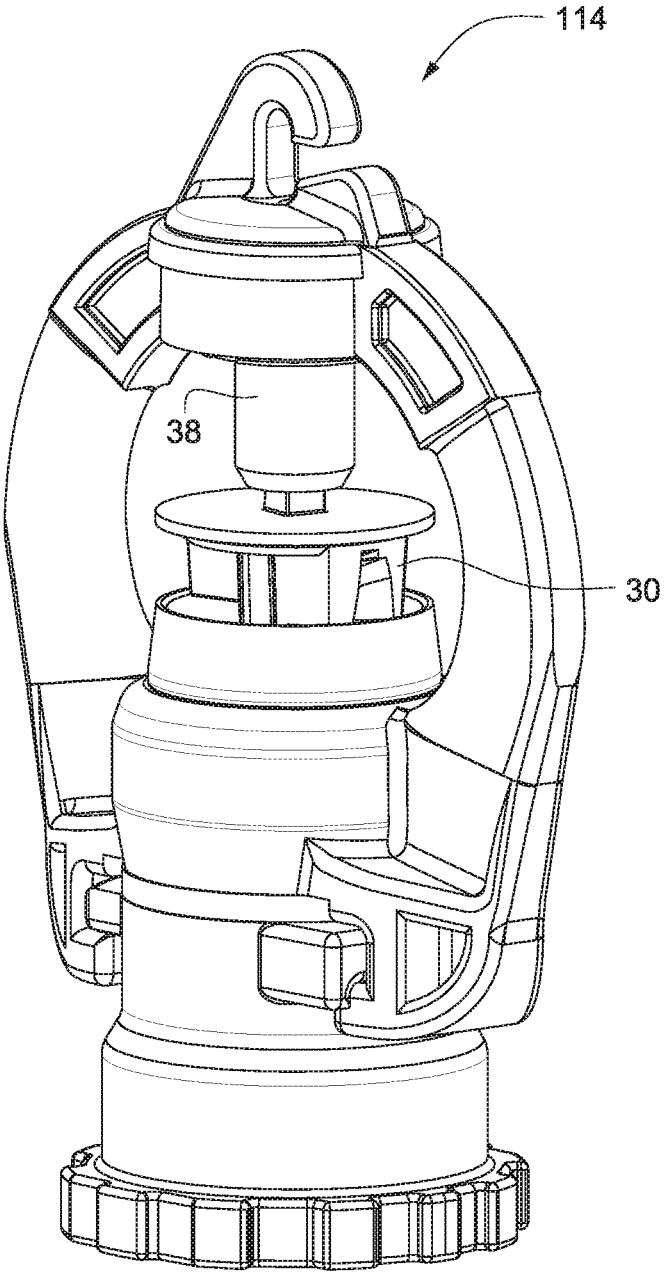
Figure 12:
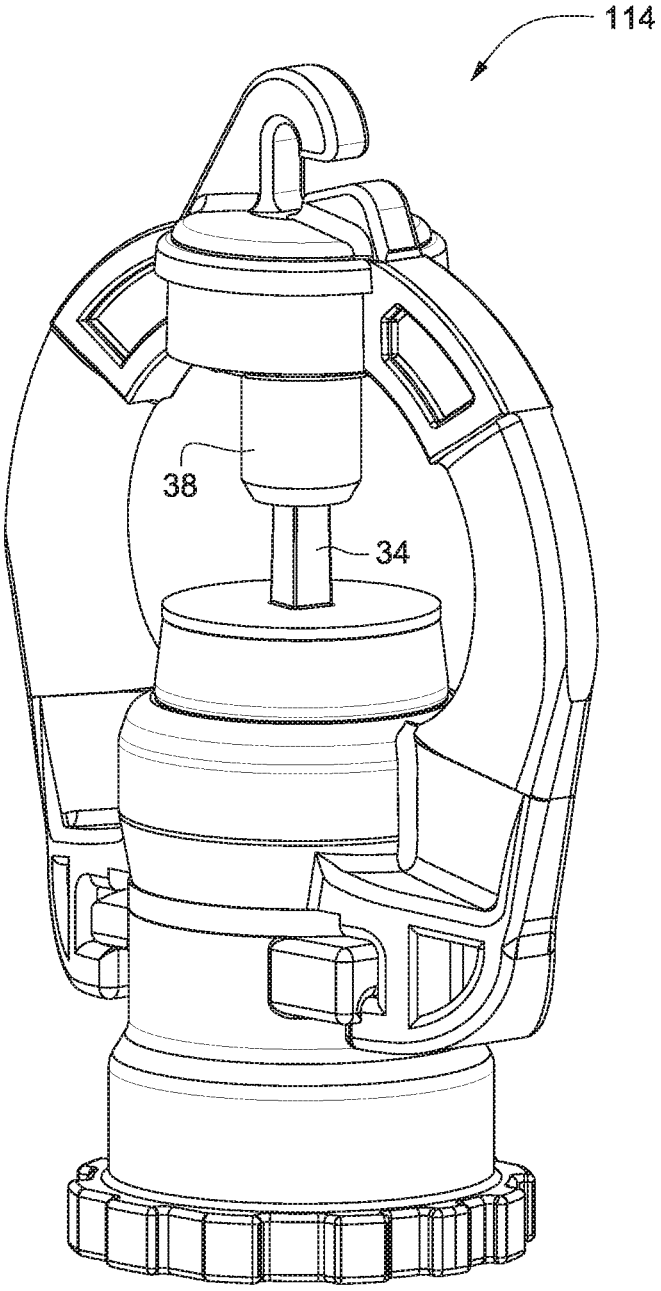
Figure 13:
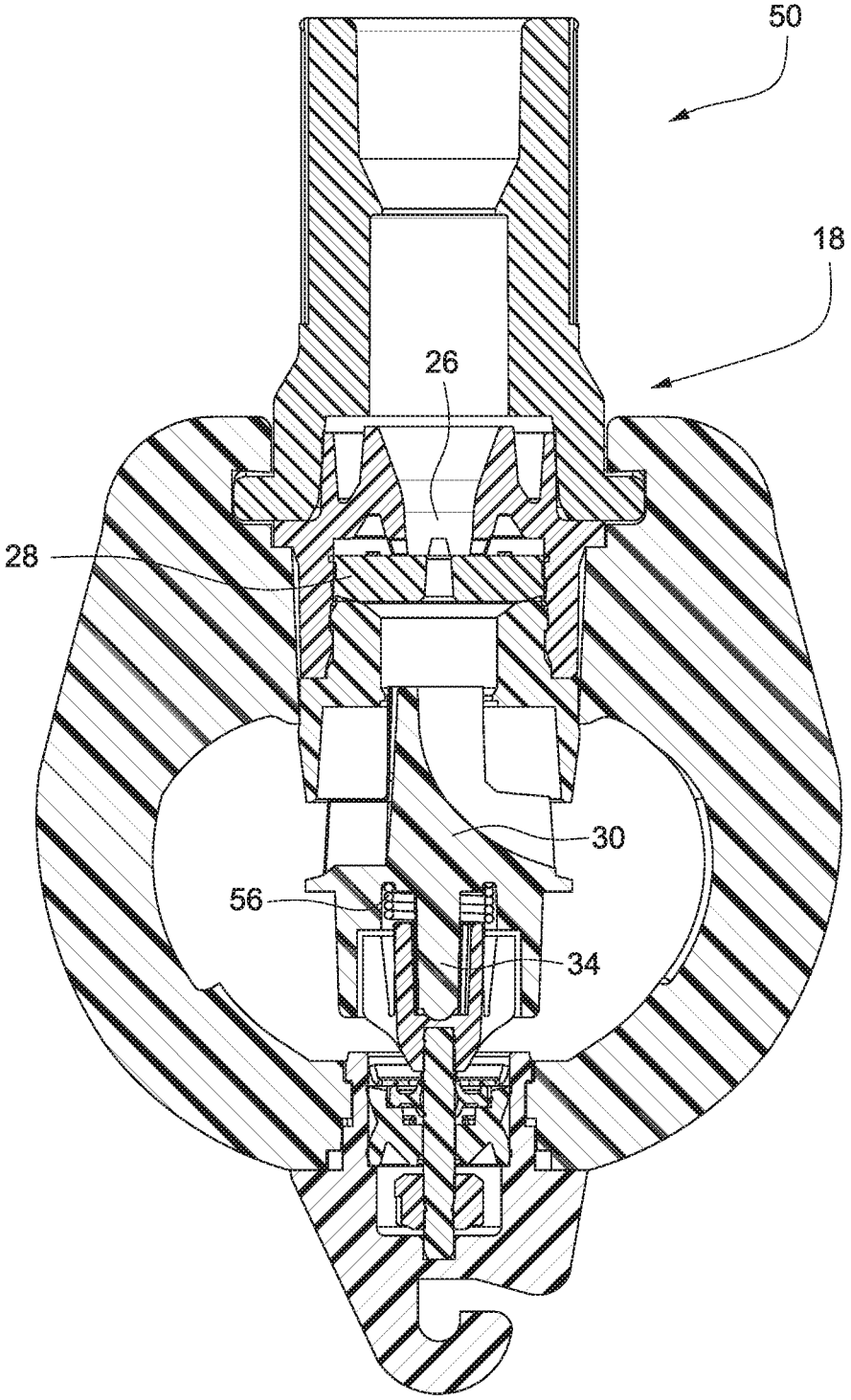
FIGS. 13-16 show a hanging rotator version of the assembly.

FIGS. 9-12 show a variation where the brake module 14 is replaced with a spinner module 114. In this variation, the deflector plate 30 is freely rotatable. As shown in FIG. 10, the spinner module 114 may include a jewel cup bearing 52 mounted in the rotatable connector 38 and/or a ball bearing 54 disposed at a distal end of the torque shaft 34 and engaged with the jewel cup bearing 52 with the deflector plate in the extended position. The bearings 52, 54 may be usable together or separately. The bearings 52, 54 can reduce wear and extend the life of the sprinkler in the spinner configuration. The variation shown in FIGS. 9-12 includes a threaded Acme adapter as the base unit 50.

Figure 14:
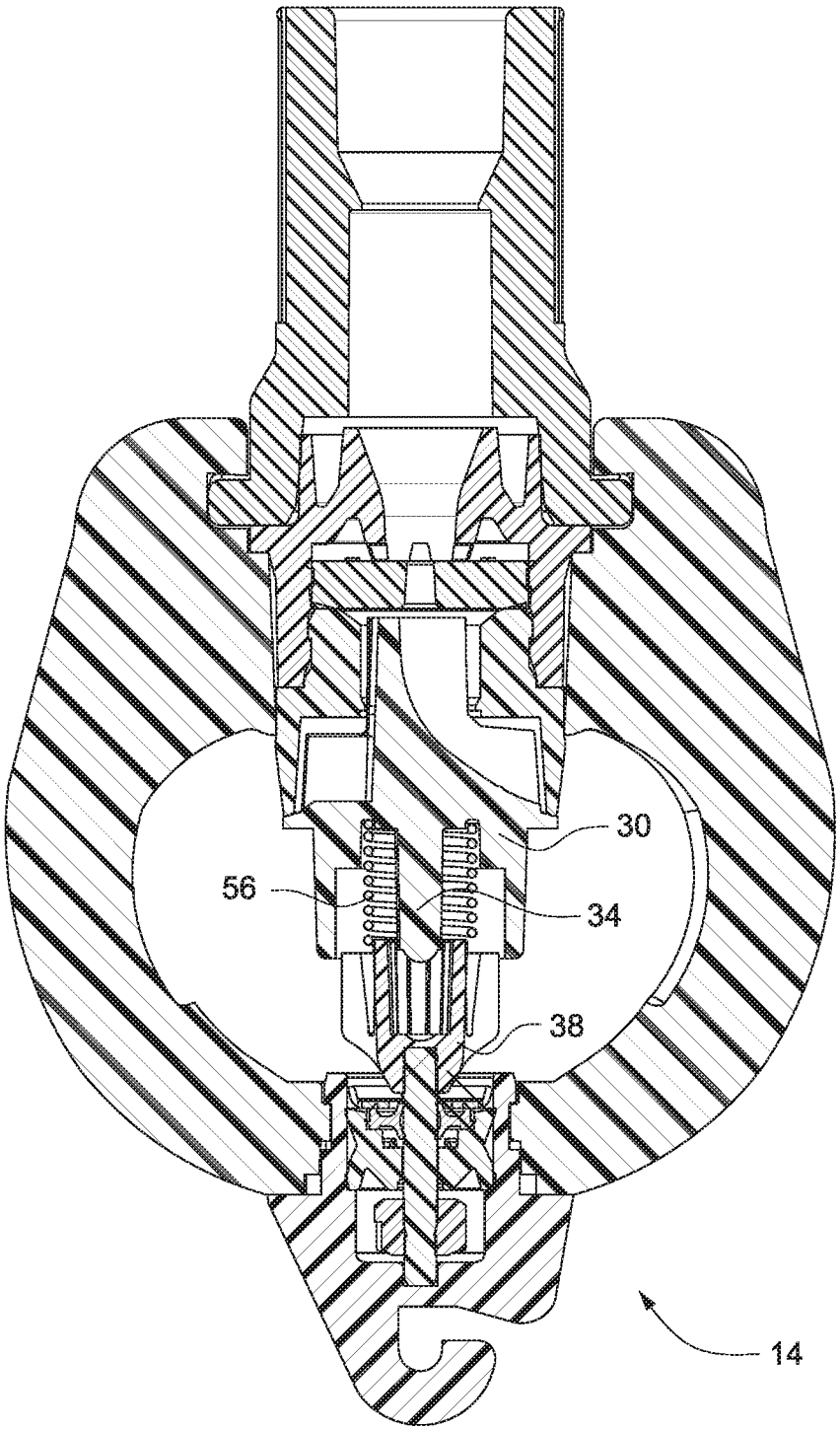
Figure 15:
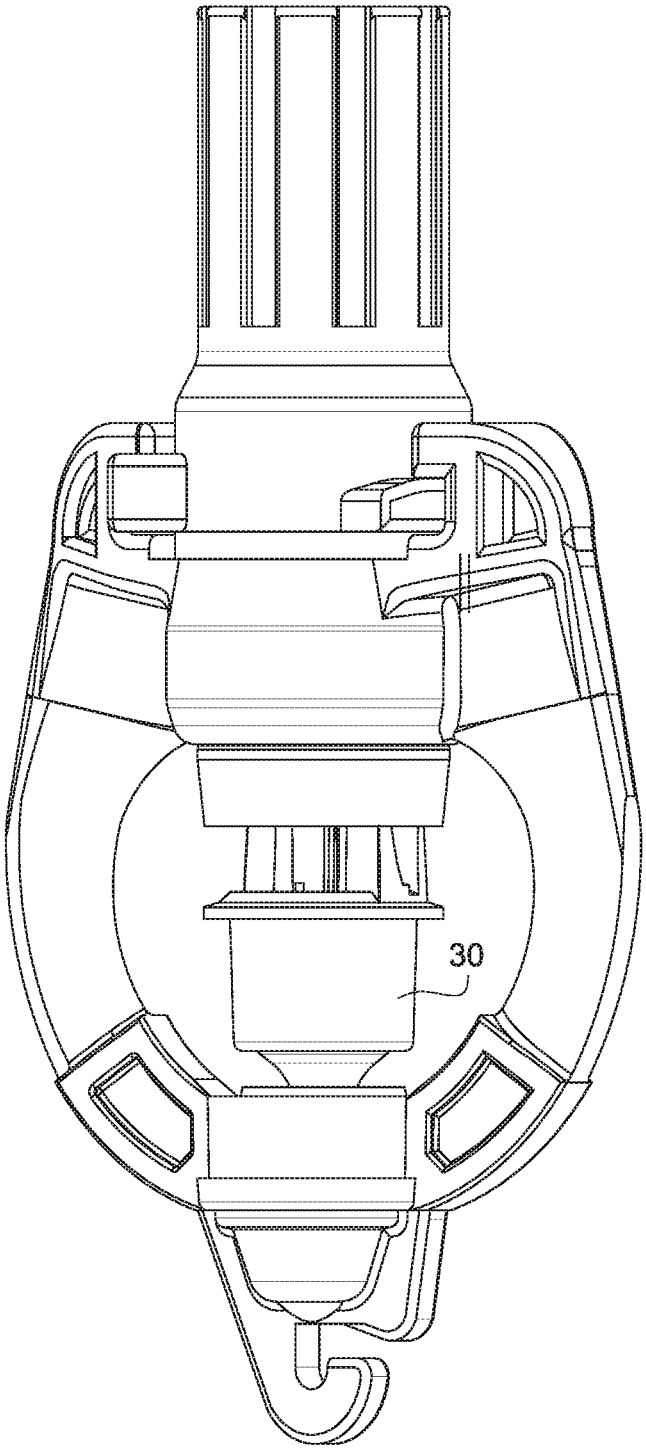
Figure 16:
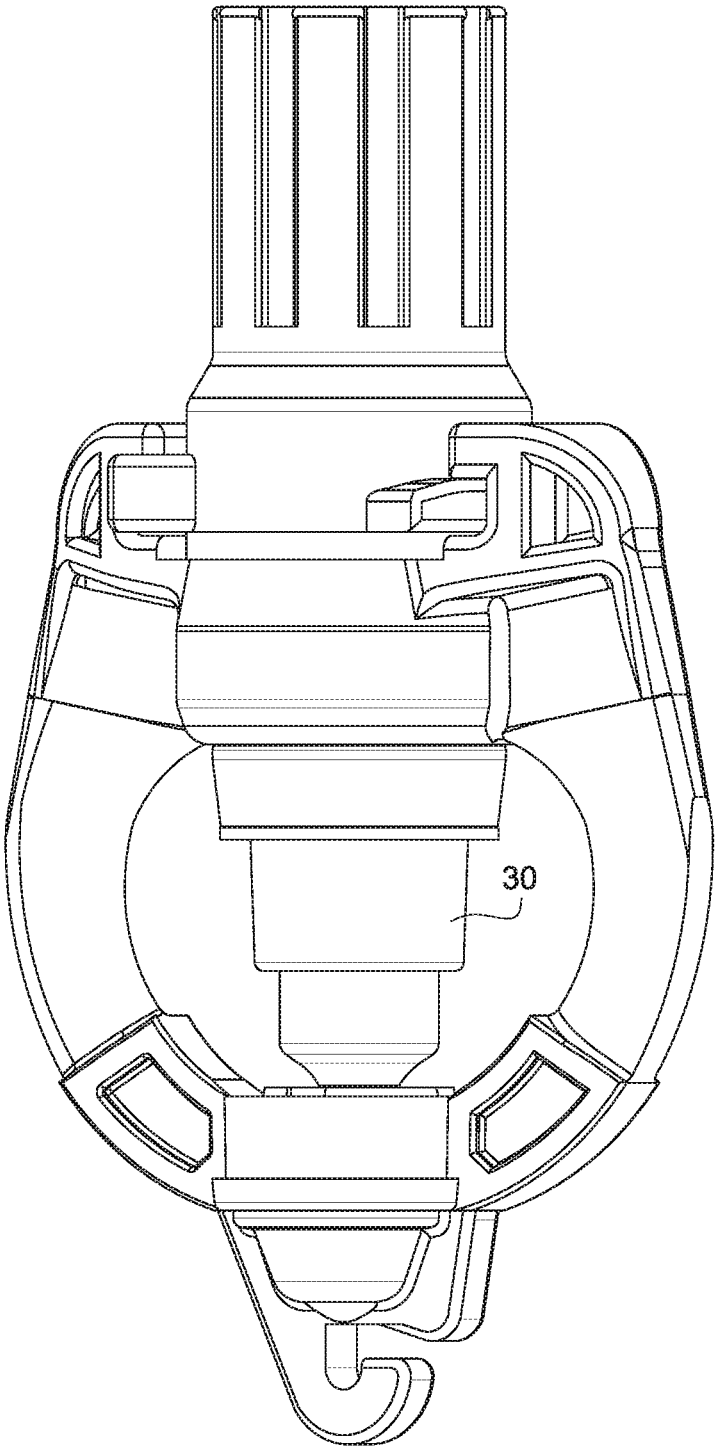

FIGS. 13-16 show a variation adapted for use as a hanging rotator. In this variation, the base unit 50 is top-mounted as shown. The nozzle module is shown with a flow control nozzle 26 and a flow control washer 28. A spring 56 is disposed over the torque shaft 34 and acts between the rotatable connector 38 and the deflector plate 30. The spring 56 biases the deflector plate 30 toward the retracted position as shown in FIGS. 14 and 16. A spring constant is selected so that the water stream emitted from the nozzle 26 impacts the deflector plate 30 and extends the deflector plate 30 from the retracted position to the extended position against the force of the spring 56. When the stream is turned off, the spring 56 draws the deflector plate 30 back to the retracted position. In this embodiment, it may be desirable to use a brake module with a reduced braking force (e.g., by using a fluid with a lower viscosity) so that the deflector plate 30 rotates faster during use. The faster rotation may be desirable in the hanging variation so that the sprinkler may maintain its center.

Figure 17:
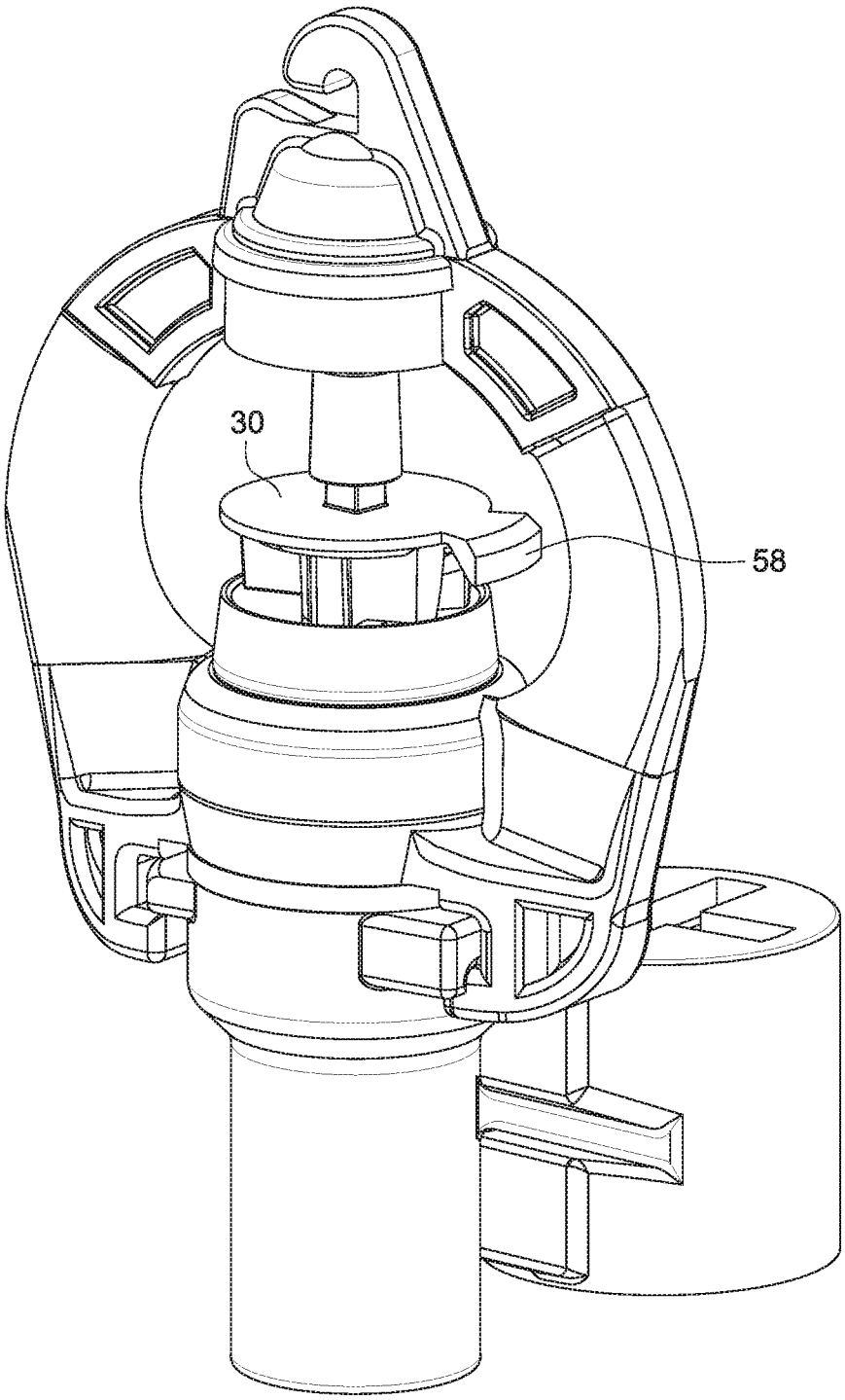
FIGS. 17 and 18 show a sprinkler assembly incorporating a short radius break-off tab for limiting a throw/disbursement range of the sprinkler.
Figure 18:
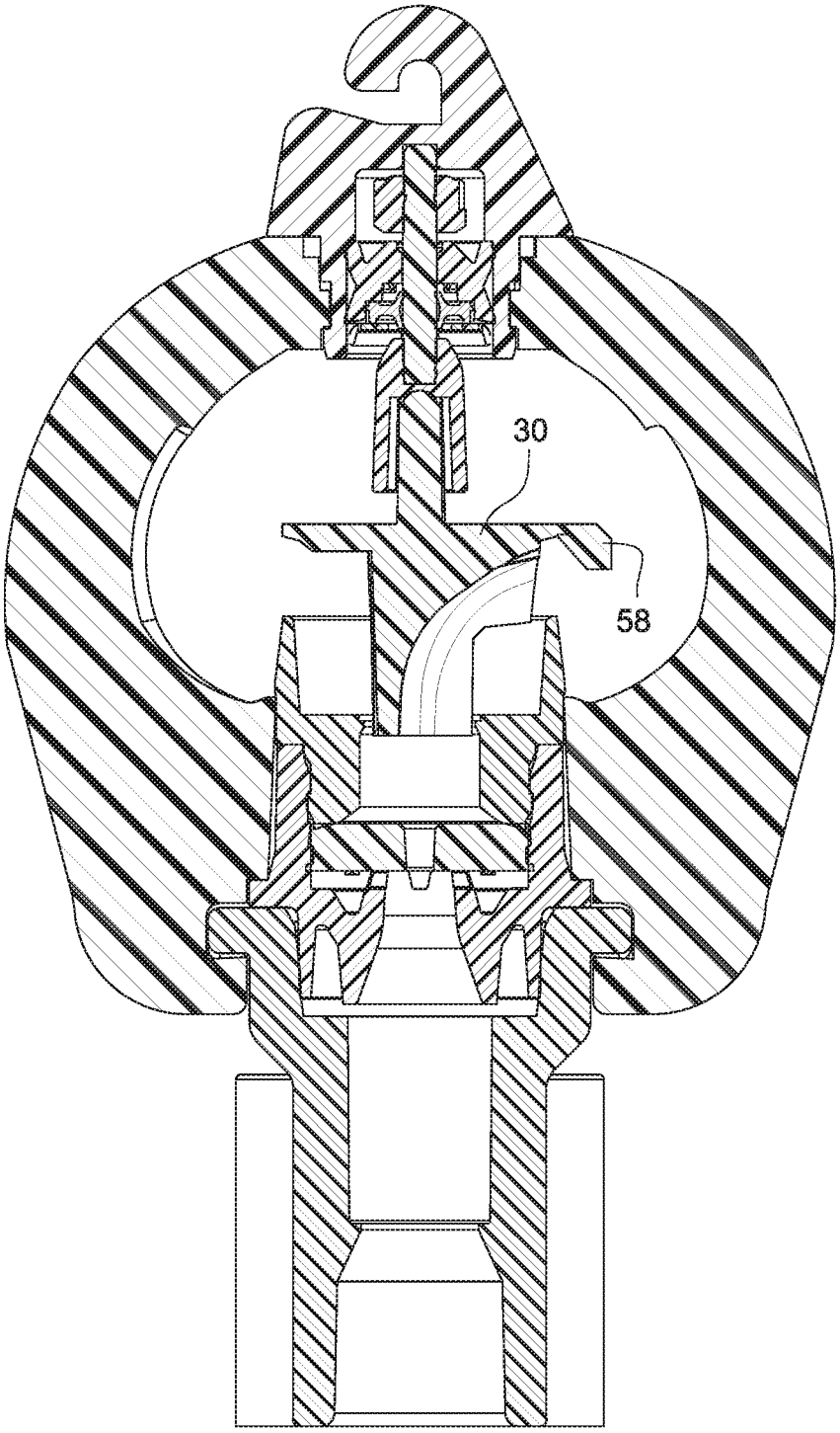

In some embodiments, it may be desirable to incorporate a breakaway diffuser tab on the deflector plate 30 as shown in FIGS. 17 and 18. The diffuser tab 58 serves to keep the water disbursement closer to the sprinkler for smaller vegetation or the like. As the vegetation grows, the breakaway diffuser tab 58 can be readily removed from the deflector plate 30. Alternatively, due to the modular construction of the sprinkler, the deflector plate 30 can be readily interchanged with a different deflector plate.

The modular construction of the described sprinkler facilitates assembly of the sprinkler into the numerous described variations as may be suitable for different intended functionalities. Thus, the assembly may include a plurality of brake modules with varying braking characteristics, a plurality of nozzle modules with varying flow characteristics, and a plurality of deflector plates with varying stream disbursement characteristics. The pluralities of brake modules, nozzle modules and/or deflector plates may be selectively and independently attachable to the sprinkler body. The varying braking characteristics extend from no braking to maximum braking as described. The nozzle modules may include nozzles having varying sizes to reflect the varying flow characteristics.

The sprinkler according to the described embodiments incorporates a pop-up deflector plate in a rotator assembly. Additionally, the modular construction enables the use of multiple variations according to intended functionality.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A sprinkler comprising:

a sprinkler body;

a brake module secured to the sprinkler body and including a rotatable connector coupled with a brake assembly;

a nozzle module cooperable with the sprinkler body and including a nozzle; and a deflector plate cooperable with the nozzle module and disposed facing the nozzle, the deflector plate being displaceable in the nozzle module between a retracted position and an extended position, the deflector plate including a stream deflector surface and a torque shaft, wherein the torque shaft is engaged with the rotatable connector in the extended position, wherein the torque shaft is tapered such that the torque shaft is disengaged from the rotatable connector in the retracted position.

2. A sprinkler according to claim 1, wherein the torque shaft is engaged with the rotatable connector in the retracted position.

3. A sprinkler according to claim 1, wherein the rotatable connector includes a channel with a cross-sectional shape, and wherein the torque shaft is shaped corresponding to the cross-sectional shape to engage the channel and to transfer torque between the deflector plate and the rotatable connector.

4. A sprinkler according to claim 3, wherein the cross-sectional shape is square, and wherein the torque shaft is shaped to fit in the square shape.

5. A sprinkler according to claim 3, wherein the cross-sectional shape comprises ridges, and wherein the torque shaft comprises splines that are engageable with the ridges.

6. A sprinkler according to claim 1, wherein the nozzle module is connected to the sprinkler body in a snap fit.

7. A sprinkler according to claim 1, wherein the rotatable connector is positioned so as to act as a stop limit for the deflector plate in the extended position.

8. A sprinkler according to claim 1, further comprising a base unit to which the nozzle module is secured, the base unit having connecting structure connectable with a source of water under pressure.

9. A sprinkler comprising:

a sprinkler body;

a brake module secured to the sprinkler body and including a rotatable connector coupled with a brake assembly;

a nozzle; and a pop-up deflector plate disposed between the nozzle and the rotatable connector in a path of a stream emitted from the nozzle, wherein a height of the pop-up deflector plate is smaller than a distance between the nozzle and the rotatable connector such that the pop-up deflector plate is displaceable in the sprinkler body between an extended position in which the pop-up deflector plate engages the rotatable connector and a retracted position in which the pop-up deflector plate is spaced from and thereby disengaged from the rotatable connector.

10. A sprinkler according to claim 9, further comprising a nozzle module secured to the sprinkler body and including a nozzle base containing the nozzle and a nozzle top in which the pop-up deflector plate is displaceable to and from the extended position.

11. A sprinkler according to claim 10, wherein the rotatable connector is positioned so as to act as a stop limit for the deflector plate in the extended position.

12. A sprinkler according to claim 9, wherein the pop-up deflector plate comprises a stream deflector surface and a torque shaft, and wherein the torque shaft is engaged with the rotatable connector in the extended position.

* * * * *